United States Patent [19]

Frazier et al.

[11] 4,065,089

[45] Dec. 27, 1977

[54] CANTILEVER RACK CONSTRUCTION

[76] Inventors: Donald Frazier, Mendham Road, Far Hills, N.J. 07931; John R. Hardin, Jr., Pottersville Road, Gladstone, N.J. 07934

[21] Appl. No.: 775,742

[22] Filed: Mar. 9, 1977

[51] Int. Cl.[2] ..... A47B 96/12

[52] U.S. Cl. ..... 248/245; 248/228; 211/193

[58] Field of Search ..... 248/245, 244, 246, 243, 248/228; 211/193, 187, 207

[56] References Cited

U.S. PATENT DOCUMENTS

| | | | |
|---|---|---|---|
| 1,034,065 | 7/1912 | Binder | 248/228 X |
| 1,489,104 | 4/1924 | Armington | 248/228 X |
| 2,447,228 | 8/1948 | Boston | 248/228 X |
| 3,204,904 | 9/1965 | Peterson | 248/246 X |
| 3,854,686 | 12/1974 | Konstant | 211/193 X |

*Primary Examiner*—Francis K. Zugel

*Attorney, Agent, or Firm*—Popper & Bobis

[57] ABSTRACT

A cantilever rack construction wherein a generally C-shaped connector plate embraces a flange of a column; threaded members pass through arms on the front of the connector plate and engage the column at or near to the root fillet; (which is the point of intersection of a flange on the column and the web of the column.)

19 Claims, 9 Drawing Figures

CANTILEVER RACK CONSTRUCTION

BACKGROUND OF INVENTION

1. Field of Invention

This invention relates to cantilever rack constructions for supporting and storing objects on cantilever beams, and particularly to such cantilever rack constructions wherein a connector plate embraces a column and is affirmatively engaged with the column by means of threaded members frictionally engaging the column at or near to the root fillet.

2. Description of Prior Art

Cantilever storage racks are the subject of numerous patents issued throughout the years: D'Altrui U.S. Pat. No. 3,371,798; Frazier U.S. Pat. No. 3,251,478; Frazier U.S. Pat. No. 3,489,291; D'Altrui U.S. Pat. No. 3,918,590; D'Altrui U.S. Pat. No. 3,689,566; Shea U.S. Pat. No. 2,163,635; Clayton U.S. Pat. No. 1,786,004; Boston U.S. Pat. No. 2,447,228. In these devices, where the flange of a column is seized by a supporting bracket, load conditions if moderate, are sustained. However under more severe loading conditions, the flange of the column is distorted and deformed, thereby altering the position of the cantilever beam and weakening the ability of the rack to support objects. Numerous braces and reinforcements particularly devised to overcome deformations of a flange on a column have not altogether overcome this problem.

SUMMARY OF INVENTION

It has been found that a cantilever rack construction can be supplied which will rigidly support a cantilever beam by attaching it to a column. The method of attachment is by a horizontally disposed connector plate supplied with a pair of integral, rigid arms on the front of the plate, and enclosing a space sufficient to receive the web of a column between the arms and a flange on the web also in the elongated space within the arms. Instead of attaching the rigid horizontally disposed connector plate to the column by threaded members directed at or near to the tips of the flange of the column, threaded members passing through the arms are directed to the root fillet of the column which is the point of intersection between the web and the flange. This point is the strongest point of the column, and attachment there has been found to provide security as well as freedom from deformation or deflection under heavy load conditions. This overcomes the difficulties of deformation that arise when a cantilever beam is supported by engaging less strong other portions of the flange on the column.

DRAWINGS

These objects and advantages as well as other objects and advantages may be obtained by the device shown by way of illustration in the drawings in which.

PREFERRED EMBODIMENT

Figure 1:
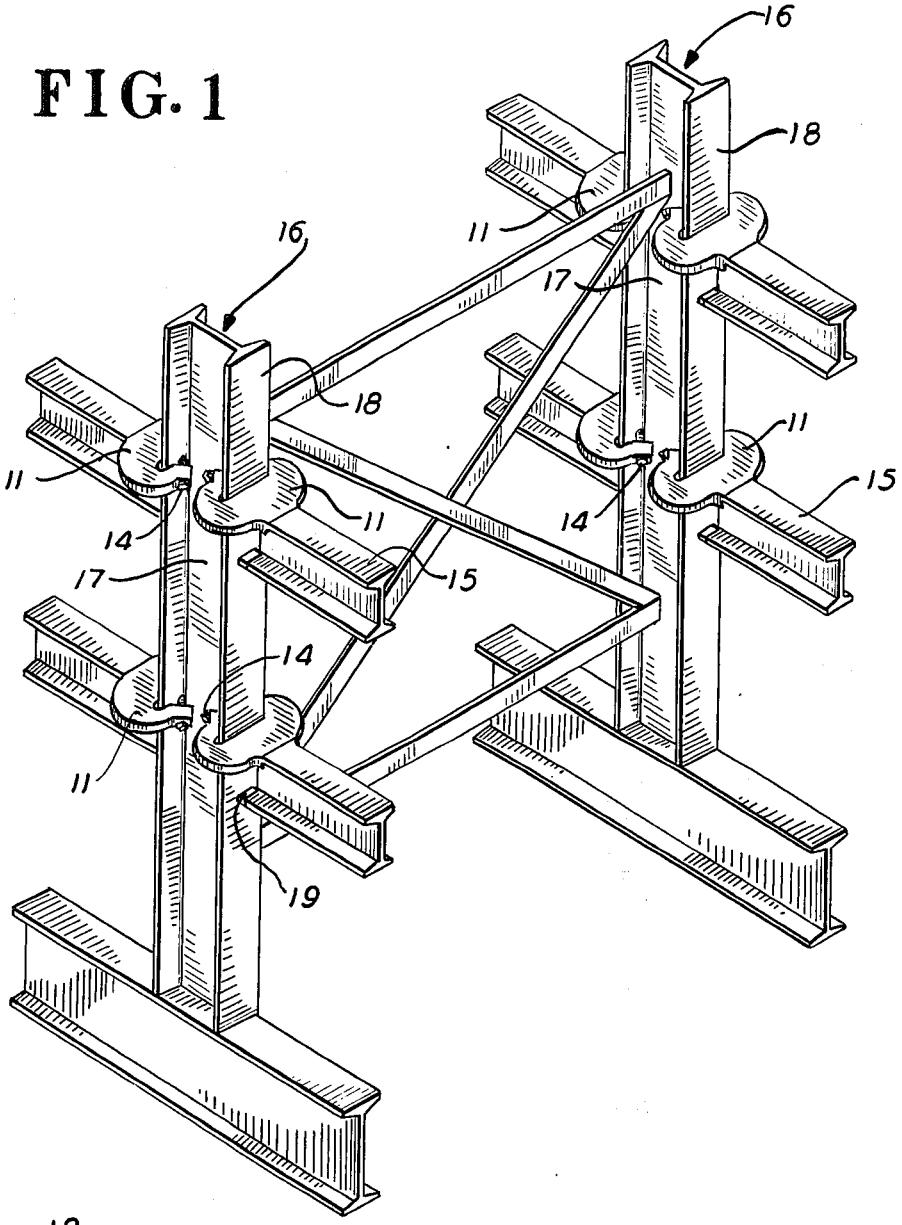
FIG. 1 is a perspective view of a rack embodying the invention.
Figure 2:
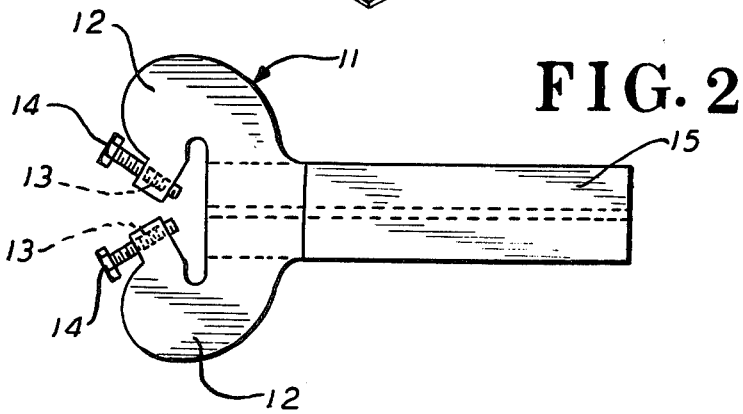
FIG. 2 is a top plan view of a cantilever arm.

Referring now to the drawings in detail, the cantilever rack construction illustrative of the present invention provides a rigid, horizontally disposed connector plate 11, preferably about 1 inch thick. This dimension is not critical, but is dependent upon the weight to be supported by a cantilever beam. For racks in which light loads are supported on the cantilever beam, the plate may be thinner, and for heavier loads, the plate may be thicker. The plate functions to secure the cantilever beam to a generally vertical column. The plate has integral rigid arms 12 on the front edge of the connector plate. The arms 12 converge toward each other, and embrace within their span, an elongated space between the arms 12 and the main portion of the connector plate 11. A threaded passage 13 is provided near the end of each arm 12. A correspondingly threaded member 14 such as a bolt is positioned in each threaded passage 13.

At the back edge of the connector plate 11, a cantilever beam i5 is attached, preferably by welding. The threaded passages 13 are directed into the elongated space toward each other i.e. the longitudinal axis of the one threaded passage is generally directed toward the longitudinal axis of the other threaded passage in the elongated space. The elongated space is dimensioned to accomodate a portion of a column 16. The column has a web 17 which is disposed between the ends of the arms 12 of the connector plate 11. A flange 18 is formed integrally with the web of the column 16 and extends in general perpendicularity to the column 16 and oppositely on both sides of the column. The flange 18 fits into the elongated space and substantially fills the same, while the web 17 extends from the flange outwardly away from the connector plate 11 and between the ends of the arms 12. The threaded members 13 are engaged with the flange 18 of the column 16 close to the web 17 of the column 16.

Since the elongated space embraced by the arms 12 only approximately matches the flange 18, the attitude of the beam 15 is somewhat variable with respect to the column 16. This attitude of the beam 15 may be established by a pitch-plate 19 attached to the bottom of the beam 15 and extending outwardly therefrom in the direction of the flange 18 of the column 16. It will be seen that a long preselected pitch-plate will cause the beam 15 to be disposed in an upward and outward direction with respect to the flange of the column. If the pitch-plate 19 is shortened somewhat, the attitude of the cantilever beam 15 may be horizontal; while if the pitch-plate 19 is still shorter, the beam may be disposed downwardly and outwardly with respect to the flange 18 of the column 16. In most instances the pitch-plate should be provided with such a length that it will maintain the beam 15 at least horizontal, or preferably extending upwardly and outwardly from the flange 18 so that objects deposited and supported on the beam 15 will not roll off but will tend to slide, if at all, toward the column 16.

To provide even greater strength for the column 16, in order to make it highly resistant to deformation, a reinforcement strip may be applied to the face of the flange 18. This strip 20 may be secured thereto along the entire vertical extent of the flange and may be welded thereto. The elongated space embraced by the arms 12 should be dimensioned sufficiently large to receive both the flange 18 of the column 11 and as well the reinforcement strip 20.

With respect to the relationship of the top of the connector plate 11 and the top of the cantilever beam 15, they should preferably be disposed in the same general horizontal plane so that material loaded on the beam may lie on the connector plate 11 close to the flange 18. While welding is the preferred means for securing the cantilever beam 15 to the back of the connector plate 11, it is possible to secure them together by bolting or someother means.

The column 15 may have the cross-sectional configuration of an H or it may be provided with the somewhat similar configuration cross-sectionally, at a T. The beam 15 may be a thick rigid member having either a preferred, cross-sectional H configuration, or a cross-sectional T configuration. The beam 15 may also be made of flat stock 22 folded to enclose, at least in part, a generally vertical cross-sectional rectangular space. The space enclosed by the folded flat stock may be uniform from one end to the other of the beam 15 or the beam may be tapered from its inner end to its outer end. (See FIGS. 5 and 5A)

Figure 3:
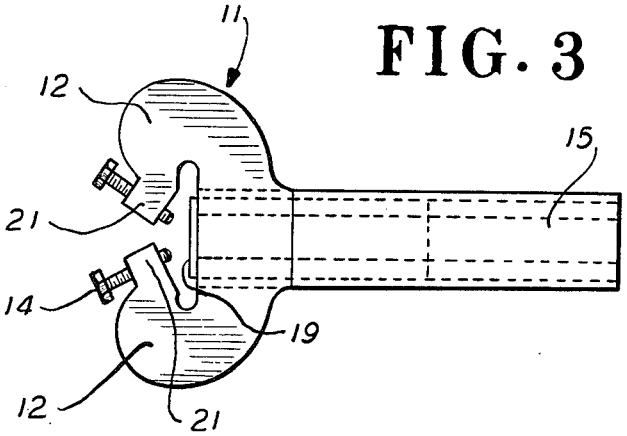
FIG. 3 is a top plan view of a cantilever arm showing the pitch plate.
Figure 4:
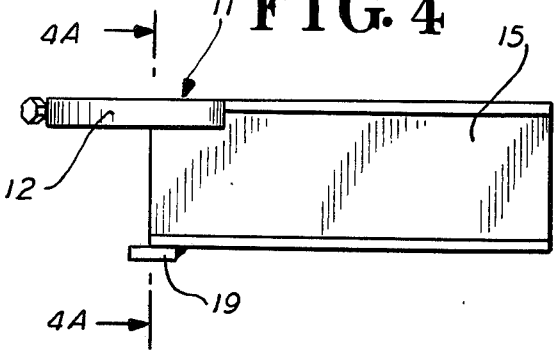
FIG. 4 is a side elevational view of a cantilever arm.
Figure 4A:
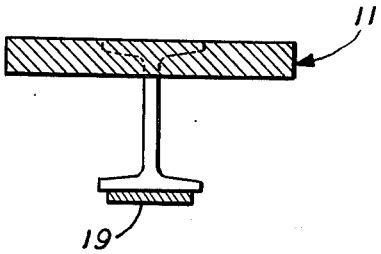
FIG. 4A is a vertical cross-sectional view of a cantilever arm taken on the line 4A—4A in FIG. 4 looking in the direction of the arrows.
Figure 6:
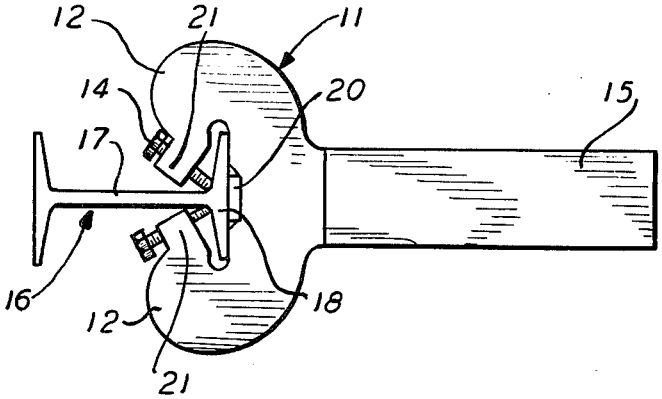
FIG. 6 is a top plan view of a cantilever arm embracing a vertical H shaped column bearing a reinforcing strip.
Figure 7:
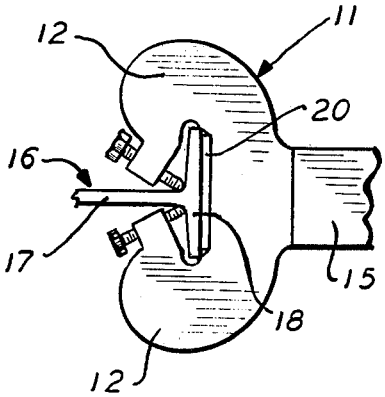
FIG. 7 is a top plan view of a cantilever arm embracing a column with a wide reinforcing strip.

The connector plate 11 is provided with integral rigid arms 12 which define a generally C-shaped connector plate 11. The end 21 of each arm where the threaded passages 13 are arranged may be somewhat narrower than the remainder of the arms 12 closer to the main body of the plate 11 as will be seen in FIGS. 3, 6, 7. These threaded passages 13, being in narrow portions of the end 21 of the arms 12 may accomodate short threaded members rather than long threaded members that would be necessary if the end of the arms were of uniform width along their entire length. Since the threaded passages converge, they are directed to the point of intersection of the flange 18 of the column 16 with the web 17 of the column 11. This point of intersection is denominated as the root fillet of the column 11 and the particularly engagement of the threaded members 13 near or into the root fillet has the advantage of gripping the connector plate 11 to the column 16 at the point of its greatest strength. This provides an arrangement whereby the flange 18 is highly resistant to torque under load conditions and will not deform or twist as is frequently the case with other rack constructions.

Figure 5:
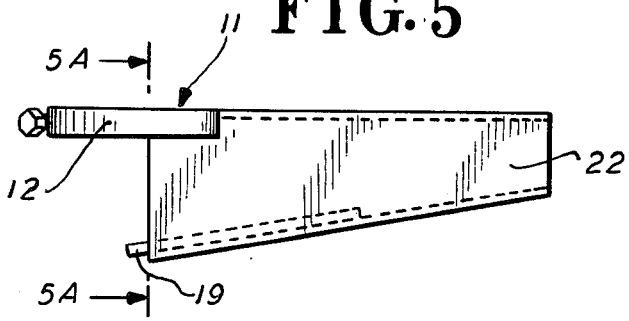
FIG. 5 is a side elevational view of a tapered cantilever arm.
Figure 5A:
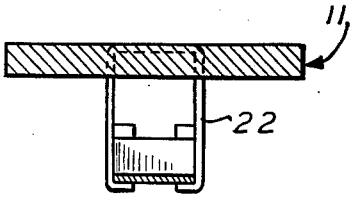
FIG. 5A is a vertical cross-sectional view taken on the line 5A—5A in FIG. 5, looking in the direction of the arrows.

Reference has been made to the pitch-plate 19 which extends outwardly from the beam 15 into attitude-controlling engagement with the column 11. This pitch-plate may likewise extend along the bottom of the beam 22 and there serve as a reinforcement of the beam 15, as shown in FIG. 5.

The threaded members 13, in their engagement with the flange 18 of the column 11 close to the web 17, will frictionally engage the column 16 and may even indent it at the point of engagement, thereby providing for a very secure and fixed relationship between the beam 15 and the column 16.

When the column 16 selected as the vertical support member has a horizontal cross-section H-shape, additional connector plates 11 may be hung on the opposite flange of the column 16 thereby providing a counter balancing weight for articles stored on the opposite side of the column 16. (See FIG. 1)

What is claimed:

1. A cantilever rack construction comprising:

a. a rigid, horizontally disposed connector plate for securing a cantilever beam to a column, b. a pair of integral, rigid arms on the front of the connector plate, c. the arms converging toward each other, and embracing an elongated space between the arms and the connector plate, d. a threaded passage in the end of each arm, e. a threaded member in each threaded passage, f. a cantilever beam for supporting objects, attached to the back of the connector plate, g. a column, h. a web on the column between the ends of the arms of the connector plate, i. a flange on the web of the column in the elongated space, j. the threaded passages directed, into the elongated space generally toward the intersection of the web with the flange of the column, k. the threaded members engaged with the back of the flange of the column at the intersection of the flange and the web of the column, l. the connector plate between the arms being in abutment with the front of the flange, when the threaded members are tightened.

2. A cantilever rack construction comprising:

a. the device according to claim 1, b. a pitch-plate attached to the beam in abutment with the flange of the column, c. the pitch-plate having an outward extension from the cantilever beam of preselected distance, whereby the angular relation of the beam with respect to the flange of the column is defined.

3. A cantilever rack construction comprising:

a. the device according to claim 1, b. a reinforcement strip covering at least a portion of the flange of the column and attached thereto, c. the elongated space sufficient to receive both the reinforcement strip and the flange of the column,

4. A cantilever rack construction comprising:

a. the device according to claim 2, b. the pitch-plate extending from the bottom of the beam a distance sufficient to tilt the beam upwardly when engaged with the flange of the column.

5. A cantilever rack construction comprising:

a. the device according to claim 3, b. a pitch-plate attached to the beam in abutment with the reinforcement strip attached to the flange of the column, c. the pitch-plate having an outward extension from the cantilever beam of preselected distance, whereby the angular relationship of the beam with respect to the column is defined.

6. A cantilever rack construction comprising:

a. the device according to claim 5, b. the pitch-plate extending from the bottom of the beam a distance sufficient to tilt the beam upwardly when engaged with the reinforcement strip attached to the flange of the column.

7. A cantilever rack construction comprising:

a. the device according to claim 2, b. the pitch-plate having an extension along the bottom of the cantilever beam, away from the column and whereby the bottom of the beam is reinforced.

8. A cantilever rack construction comprising:
a. the device according to claim 5,
b. the pitch-plate having an extension along the bottom of the cantilever beam, away from the column, and whereby the bottom of the beam is reinforced.
9. A cantilever rack construction comprising:
a. the device according to claim 1,
b. the top of the connector plate, and the top of the cantilever beam lying in the same general plane.
10. A cantilever rack construction comprising:
a. the device according to claim 1,
b. the cantilever beam and the back of the connector plate attached together by welding.
11. A cantilever rack construction comprising:
a. the device according to claim 1,
b. the beam being formed from folded flat-stock.
12. A cantilever rack construction comprising:
a. the device according to claim 1,
b. the column having a cross-sectional H-shape.
13. A cantilever rack construction comprising:
a. the device according to claim 1,
b. the column having a cross-sectional T-shape.
14. A cantilever rack construction comprising:
a. the device according to claim 1,
b. a narrowed portion at the end of the arms, where the threaded passages are arranged to accomodate a short threaded member.
15. A cantilever rack construction comprising:
a. the device according to claim 1,
b. root fillets defined by the intersection of the flange of the column with the web of the column,
c. the point of engagement of the threaded members being with the root fillets of the column.
16. A cantilever rack construction comprising:
a. the device according to claim 1,
b. the pitch-plate attached along the bottom of the beam as a reinforcement of the beam, and also the end of the pitch-plate in abutment with the flange of the column.
17. A cantilever rack construction comprising:
a. the device according to claim 1,
b. the engagement of the threaded members with the flange of the column at the intersection of the flange and the web of the column, being frictional and indenting the flange at the point of engagement.
18. A cantilever rack construction comprising:
a. the device according to claim 1,
b. the column having a cross-sectional H-shape with a flange on opposite vertical edges,
c. an additional connector plate mounted on the opposite flange of the column.
19. A cantilever rack construction comprising:
a. a rigid, horizontally disposed connector plate for securing a cantilever beam to a column,
b. a pair of integral, rigid arms on the front of the connector plate,
c. the arms converging toward each other, and embracing an elongated space between the arms and the connector plate,
d. a threaded passage in the end of each arm,
e. a threaded member in each threaded passage,
f. a cantilever beam for supporting objects attached to the back of the connector plate,
g. a column,
h. a web on the column between the ends of the arms of the connector plate,
i. a flange on the web of the column in the elongated space,
j. the threaded passages directed into the elongated space toward the intersection of the web with the flange of the column,
k. the threaded members engaged with the flange of the column at the intersection of the flange and the web of the column,
l. a pitch-plate attached to the beam and extending toward the flange of the column,
m. the pitch-plate having an outward extension from the cantilever beam a preselected distance, whereby the angular relation of the beam with respect to the flange of the column is defined,
n. a reinforcement strip covering at least a portion of the flange of the column and attached thereto,
o. the elongated space being sufficient to receive both the reinforcement strip and the flange of the column,
p. the pitch-plate extending from the bottom of the beam a preselected distance sufficient to attain a predetermined angular relation of the beam to the column,
q. the top of the connector plate and the top of the cantilever beam lying in the same general plane,
r. the cantilever beam and the back of the connector plate attached together by welding,
s. the column having a cross-sectional T-shape,
t. root fillets defined by the intersection of the flange of the column with the web of the column,
u. the point of engagement of the threaded members being generally with the root fillets of the column,
v. the engagement of the threaded members with the root fillets being frictional and also indenting the root fillets,
w. the connector plate between the arms being in abutment with the front of the flange when the threaded members are tightened.

* * * * *